US010024089B2

(12) United States Patent
Hutton et al.

(10) Patent No.: US 10,024,089 B2
(45) Date of Patent: Jul. 17, 2018

(54) TAMPER RESISTANT HINGE ASSEMBLIES

(71) Applicant: American Bolt & Screw Mfg. Inc., Fontana, CA (US)

(72) Inventors: Joshua Colby Hutton, Victorville, CA (US); Mark Edward Voss, Fontana, CA (US)

(73) Assignee: AMERICAN BOLT & SCREW MFG. INC., Fontana, CA (US)

( * ) Notice: Subject to any disclaimer, the term of this patent is extended or adjusted under 35 U.S.C. 154(b) by 0 days.

(21) Appl. No.: 15/214,008

(22) Filed: Jul. 19, 2016

(65) Prior Publication Data

US 2018/0023328 A1 Jan. 25, 2018

(51) Int. Cl.

| | |
|---|---|
| ***E05D 11/00*** | (2006.01) |
| ***E05D 3/02*** | (2006.01) |
| ***E05C 19/00*** | (2006.01) |
| *E05D 11/04* | (2006.01) |

(52) U.S. Cl.

CPC ..... *E05D 11/0018* (2013.01); *E05C 19/003* (2013.01); *E05D 3/02* (2013.01); *E05D 11/0027* (2013.01); *E05D 2003/027* (2013.01); *E05D 2011/0036* (2013.01); *E05D 2011/045* (2013.01)

(58) Field of Classification Search

CPC ..... E05D 11/0018; E05D 11/0027; E05D 2011/0036; E05D 2011/045; E05C 19/003

See application file for complete search history.

(56) References Cited

U.S. PATENT DOCUMENTS

| | | | | | |
|---|---|---|---|---|---|
| 721,045 | A * | 2/1903 | Keller | E05C 19/08 | 292/285 |
| 722,344 | A * | 3/1903 | Wirt | E05C 19/08 | 16/251 |
| 1,222,649 | A * | 4/1917 | Marshall | E05C 19/08 | 292/281 |
| 1,301,749 | A * | 4/1919 | Roe | E05B 65/0864 | 292/175 |
| 1,389,450 | A * | 8/1921 | Kules | E05C 19/08 | 16/251 |
| 1,754,013 | A * | 4/1930 | Fisher | E05D 3/02 | 16/380 |
| 1,799,861 | A * | 4/1931 | Muzzio | E05C 19/08 | 292/281 |
| 1,917,321 | A * | 7/1933 | North | E05D 3/02 | 16/380 |
| 2,023,249 | A * | 12/1935 | Soss | E05D 3/02 | 16/251 |
| 2,046,078 | A * | 6/1936 | Marshall | E05C 19/08 | 292/281 |

(Continued)

*Primary Examiner* — Jeffrey O'Brien
(74) *Attorney, Agent, or Firm* — Cislo & Thomas, LLP

(57) ABSTRACT

A hinge assembly includes a hinge plate having a pin-receiving portion at a first end defining a passageway along the first end, and including a plurality of mounting holes. A pivot arm has a pin-receiving portion at a first end defining a passageway that is substantially coaxial with the passageway of the hinge plate. A hinge pin is disposed in the passageways to pivotally couple the pivot arm to the hinge plate. The pivot arm is pivotable between a closed position and an open position. The pivot arm includes a domed portion forming a cavity positioned to overlie one of the mounting holes in the hinge plate when the pivot arm is in the closed position.

6 Claims, 3 Drawing Sheets

(56) References Cited

U.S. PATENT DOCUMENTS 2,151,240 A * 3/1939 Soss ..... E05D 3/02 16/251
2,183,834 A * 12/1939 Ferris ..... E05C 19/08 292/283
2,315,488 A * 4/1943 Aldeen ..... E05D 3/02 16/380
2,739,342 A * 3/1956 Pickett ..... E05D 5/06 16/389
D183,261 S * 7/1958 Mink ..... D8/327
2,972,165 A * 2/1961 McClellan ..... E06B 5/006 109/64
3,252,179 A * 5/1966 Watson ..... E05D 11/0054 16/250
3,281,177 A * 10/1966 Tenenbaum ..... E05C 19/002 292/202
3,290,718 A * 12/1966 Keierleber ..... E05D 11/0081 16/380
3,370,877 A * 2/1968 Hallberg ..... B60J 5/0497 292/241
3,591,247 A * 7/1971 Berry ..... E05D 7/12 16/382
3,787,082 A * 1/1974 Foote ..... E05C 19/08 292/281
4,063,330 A * 12/1977 Triplette ..... E05D 11/1014 16/321
4,079,974 A * 3/1978 Roper ..... E05C 19/08 292/281
4,331,356 A * 5/1982 Noel ..... E05C 19/08 292/281
4,397,488 A * 8/1983 Pastva ..... E05C 19/002 292/210
4,761,852 A * 8/1988 Sauber ..... E05D 7/04 16/237
4,793,163 A * 12/1988 MacFarlane ..... E05C 19/08 16/374
4,852,920 A * 8/1989 Deforrest, Sr. ..... E05B 67/38 292/205
5,046,770 A * 9/1991 Hansen ..... E05B 83/10 292/218
5,129,770 A * 7/1992 Coleman ..... A47G 3/00 411/373
5,419,666 A * 5/1995 Best ..... E04D 3/38 411/373
5,456,506 A * 10/1995 Bartlett ..... E05C 19/08 16/223
5,462,320 A * 10/1995 Davis ..... E05B 17/10 29/434
5,562,316 A * 10/1996 Bullock ..... E05B 83/10 292/202
6,151,757 A * 11/2000 Beals, Jr. ..... E05D 5/12 16/262
6,581,425 B1 * 6/2003 Brown ..... E05B 83/02 292/150
6,854,775 B2 * 2/2005 Senn ..... E05B 17/0025 292/259 R
6,860,530 B2 * 3/2005 Senn ..... E05B 17/0025 292/259 R
7,059,019 B1 * 6/2006 Klingler ..... E05B 67/383 16/261
8,146,205 B2 * 4/2012 Conner ..... E05B 83/10 16/250
2004/0155470 A1 * 8/2004 Senn ..... E05B 17/0025 292/285
2004/0155471 A1 * 8/2004 Senn ..... E05B 17/0025 292/285
2009/0250950 A1 * 10/2009 Jeffries ..... E05C 19/001 292/259 R
2010/0088850 A1 * 4/2010 Dringenberg ..... E05D 11/0054 16/251

* cited by examiner

TAMPER RESISTANT HINGE ASSEMBLIES

BACKGROUND

The present invention relates generally to hinges, and more particularly to a tamper resistant hinge assembly and to locks employing a tamper resistant hinge assembly.

A hinge commonly employs a hinge plate and a pivot arm held together by a pin around which the hinge plate and pivot arm can rotate with respect to one another. The hinge plate is typically fixed by fastening it to, for example, a fixed object such as a wall or a door frame in a wall, usually attached to the frame using screws or bolts through mounting holes formed in the hinge plate. The pivot arm is attached to a moveable object such as a door. The pivot arm pivots around the pin thus allowing the door or other moveable object to pivot with respect to the fixed object. In many applications, more than one hinge is provided between the fixed object and the moveable object.

In some applications, the hinges are arranged so that the pivot arm overlaps the hinge plate when the door is in the closed position. An example of such a hinge arrangement is found in a bar lock configuration for trailer doors.

In some situations, it is desired to control access to the space behind a door, and lock mechanism may be provided to control access to the space behind the door. In some applications, one or both of the hinge plate and the pivot arm are fastened to the face of the frame and the door and are thus exposed when the door is in a closed position. This provides an opportunity to defeat the lock mechanism by removing the fasteners that attach one of the hinge plate and the pivot arm to either the door or the frame.

BRIEF DESCRIPTION

A hinge assembly includes a hinge plate having a pin-receiving portion at a first end defining a passageway along the first end, and including a plurality of mounting holes. A pivot arm has a pin-receiving portion at a first end defining a passageway that is substantially coaxial with the passageway of the hinge plate. A hinge pin is disposed in the passageways to pivotally couple the pivot arm to the hinge plate. The pivot arm is pivotable between a closed position and an open position. The pivot arm includes a domed portion forming a cavity positioned to overlie one of the mounting holes in the hinge plate when the pivot arm is in the closed position.

According to the present invention, a pivot arm of a hinge is provided with a raised dome on the pivot arm that covers one of the mounting holes in the hinge plate when the hinge is in the closed position and the pivot arm overlaps the hinge plate. The raised dome allows clearance for a bolt head or screw head so when closed will not interfere with the full motion of the hinge.

Most hinge plates employ more than one mounting hole. It is common to encounter hinge plates provided with three mounting holes. When the center one of the three mounting holes is occupied by a fastener and the hinge is in the closed locked position the pivot arm completely covers and blocks access to the fastener in the center mounting hole. This feature secures the mounting fastener from being removed, adding extra security against theft.

If the tamper resistant feature is not needed the user may simply skip the middle mounting hole installation. The design allows for a single item to be used as a tamper resistant lock or a standard lock at the user's option.

A pair of tamper resistant hinge assemblies are attached to a bar to form a bar lock device.

BRIEF DESCRIPTION OF THE DRAWING FIGURES

The invention will be explained in more detail in the following with reference to embodiments and to the drawing in which are shown:

DETAILED DESCRIPTION

Persons of ordinary skill in the art will realize that the following description of the present invention is illustrative only and not in any way limiting. Other embodiments of the invention will readily suggest themselves to such skilled persons.

Figure 1:
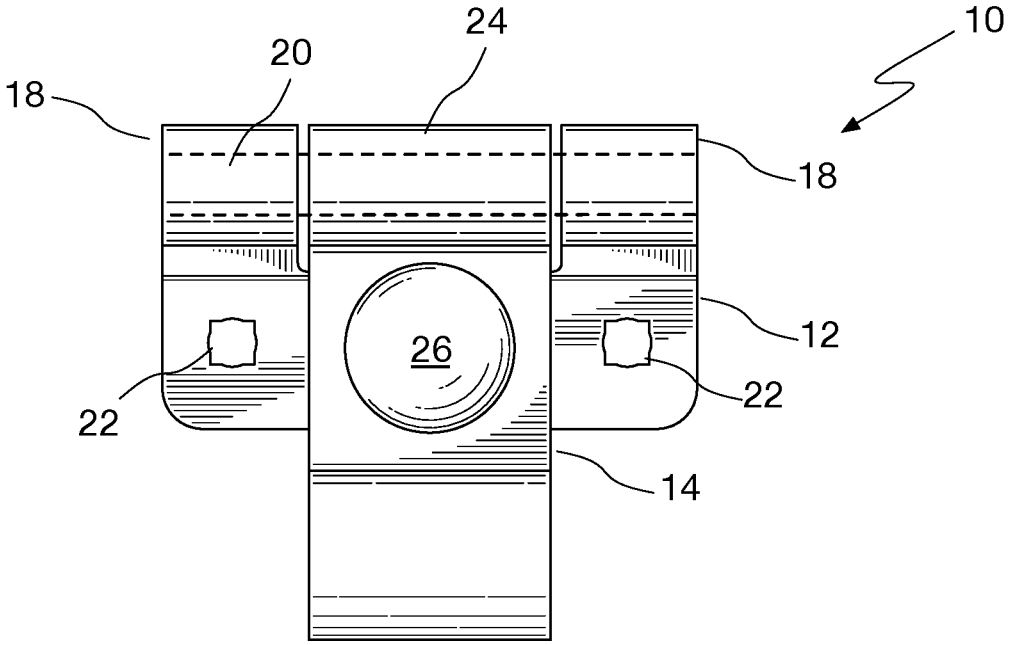
FIG. 1 is a top view of a hinge assembly in a closed position in accordance with one aspect of the present invention.

Referring now to FIG. 1 a top view shows a hinge assembly 10 in a closed position in accordance with one aspect of the present invention. Hinge assembly 10 includes a hinge plate 12 and pivot arm 14. The hinge plate 12 and pivot arm are preferably formed from a low carbon steel and may be formed by a process such as metal stamping.

Figure 2:
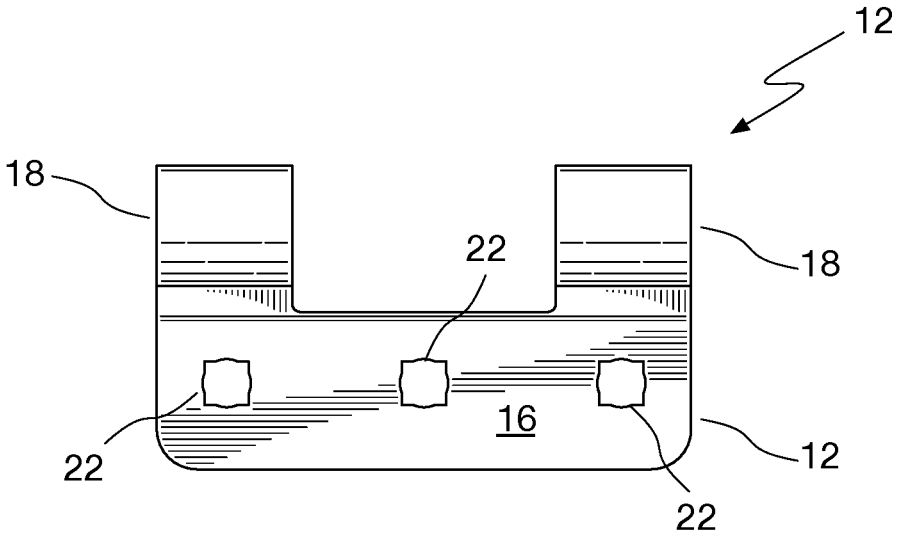
FIG. 2 is a top view of the hinge plate portion of the hinge assembly of FIG. 1.

As most easily seen with reference to FIG. 2, a top view of the hinge plate 12, hinge plate 12 includes a flat portion 16 and a pair of spaced apart pin receiving portions 18 that form a coaxially aligned passage for a hinge pin 20. A plurality of mounting holes 22 are provided in the flat portion 16 of the hinge plate 12 to accept fasteners such as screws or bolts used to affix hinge plate 12 to a mounting surface such as a doorframe.

Figure 3A:
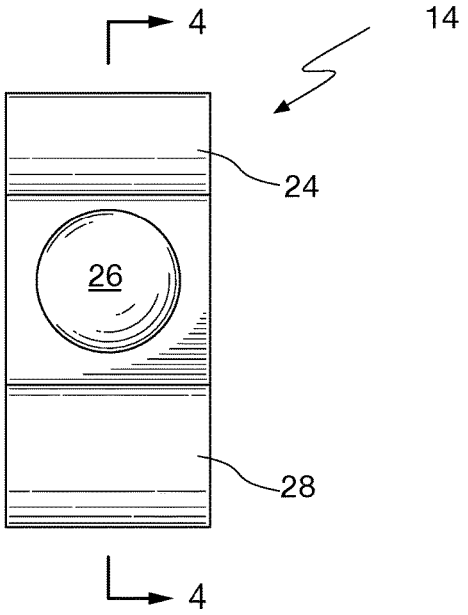
FIGS. 3A and 3B are top and side views, respectively, of the pivot arm portion of the hinge assembly of FIG. 1.
Figure 3B:
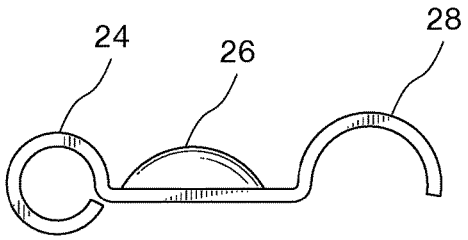

FIGS. 3A and 3B are top and side views, respectively, of the pivot arm 14 of the hinge assembly 10 of FIG. 1. The pivot arm 14 includes a pin receiving portion 24 coaxially aligned with pin receiving portions 18 of hinge plate 12 and having a width substantially equal to the spacing between pin receiving portions 18 of hinge plate 12 so as to provide clearance to allow a sliding fit between pin receiving portions 18 of hinge plate 12 and pin receiving portion 24 of pivot arm 14. After the hinge plate 12 and pivot arm 14 have been coupled together by the hinge pin 20, the pin may be captured and its removal prevented by pinching the outer ends of the pin receiving portions 18 of the hinge plate 12.

Pivot arm 14 includes a domed region 26 positioned to cover the center one of mounting holes 22 in hinge plate 12 when the hinge assembly 10 is in its closed position. The domed region 26 a height and diameter sufficient to provide clearance for the head of a fastener such as a screw or bolt disposed in a center one of mounting holes 22 of the hinge plate 12.

Figure 4:
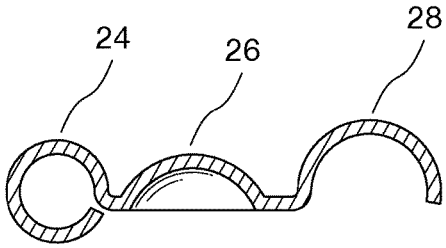
FIG. 4 is a cross-sectional view of the pivot arm of the hinge assembly of FIG. 1 taken through lines 4-4.

In one embodiment of the invention, shown in FIGS. 3A, 3B, and 4, the distal end of pivot arm 14 is formed in an arcuate shape as shown at reference numeral 28 to facilitate attaching it to a bar, for example by welding, in an embodiment where hinge assembly 10 is employed in a bar lock apparatus.

Referring now to FIG. 4, a cross-sectional view of the pivot arm 14 of the hinge assembly 10 of FIG. 1 taken through lines 4-4 of FIG. 3A shows the interior of domed portion 26.

Figure 5:
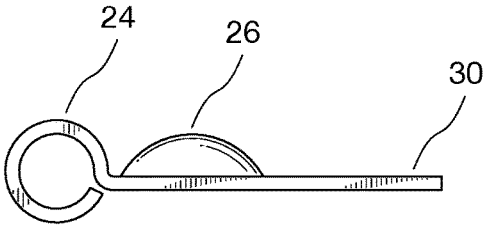
FIG. 5 is a side view of an alternative embodiment of the pivot arm portion of the hinge assembly of FIG. 1.
Figure 6:
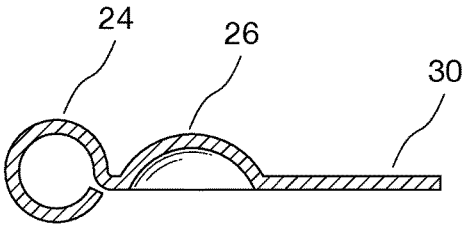
FIG. 6 is a cross-sectional view of the pivot arm of FIG. 5.

In another embodiment of the invention illustrated in FIG. 5 and FIG. 6, the distal end of the pivot arm 14 is planar in shape as shown at reference numeral 30 and allows the pivot arm 14 to be fastened to a flat mounting surface by, for example, welding or a bonding process.

Figure 7A:
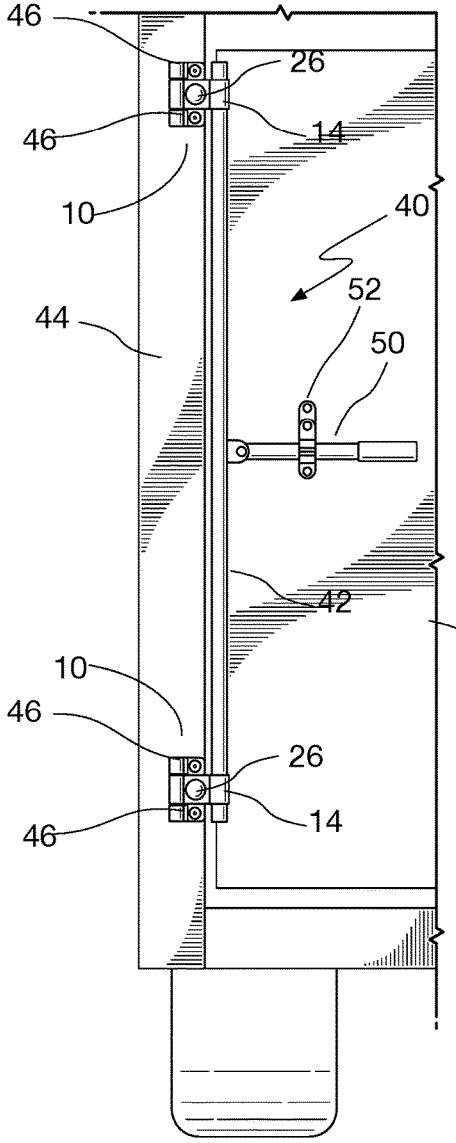
FIG. 7A is a view of a bar lock formed using a pair of hinge assemblies in accordance with the present invention and shown in a closed position.
Figure 7B:
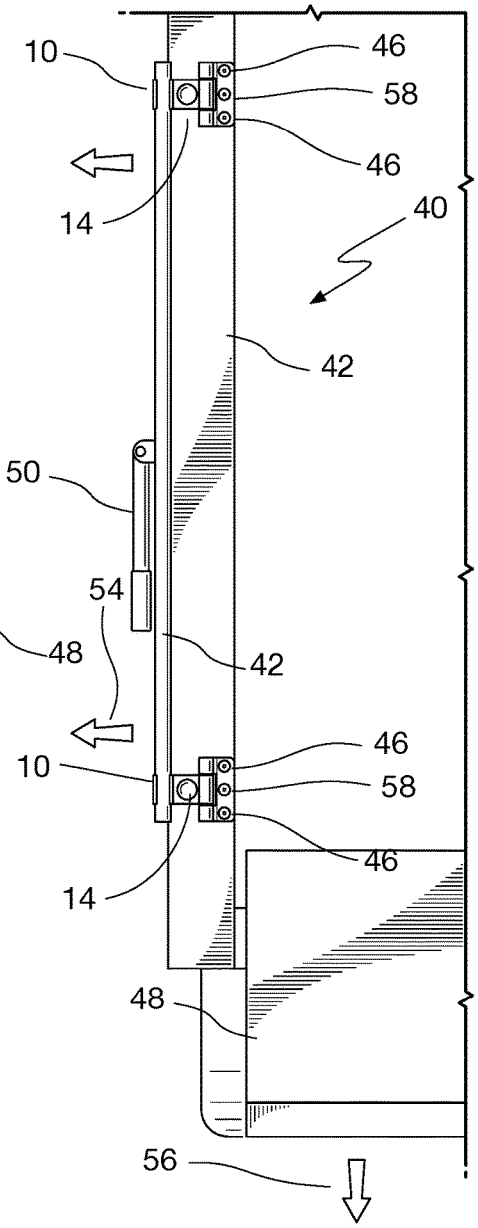
FIG. 7B is another view of the bar lock of FIG. 5A shown in an open position.

According to another aspect of the present invention, hinge assemblies in accordance with the present invention may be used to fabricate a bar lock as shown in FIGS. 7A and 7B in a typical application on a trailer. Persons of ordinary skill in the art will readily appreciate that the particular application to a trailer depicted in FIGS. 7A and 7B is illustrative only to show a particular application of the invention and is not limiting.

FIG. 7A is a view of a bar lock 40 formed using a pair of hinge assemblies 10 attached to a bar 42 in accordance with the present invention and shown in a closed position. Spaced apart hinge plates 10 are fastened to a doorframe 44. In the view shown in FIG. 7A, fasteners 46 are shown in the end holes of both of the hinge plates 10 and the center fastener in each hinge plate 10 is not shown as it is hidden under the dome 26 of pivot arm 14.

In the closed position of the bar lock 40, the bar 42 interferes with the door 48, preventing it from opening. The bar 42 has been moved (shown by arrow 54 in FIG. 7B) by freeing the handle 50 from lock clasp 52 and rotating the bar towards the left of the figure.

The open position of the bar lock 40 is illustrated in FIG. 7B. Moving handle pivots the bar on pivot arms 14 of each hinge assembly 10. The bar 42 is now clear of the door 48, which is shown lowered to its ramp position in FIG. 7B (shown by arrow 56 in FIG. 7B). Note that the center fasteners 58 of both hinge assemblies are now visible and accessible once the bar 42 has been swung out into its open position.

Although the present invention has been discussed in considerable detail with reference to certain preferred embodiments, other embodiments are possible. Therefore, the scope of the appended claims should not be limited to the description of preferred embodiments contained in this disclosure.

What is claimed is:

1. A tamper resistant hinge assembly comprising:

a generally planar hinge plate having first and second ends, a pin-receiving portion disposed along the first end, the pin-receiving portion defining a passageway along the first end of the hinge plate, the hinge plate including a flat portion having three spaced apart mounting holes formed therethrough;

a generally planar pivot arm having first and second ends, a pin-receiving portion disposed along the first end, the pin receiving portion defining a passageway that is substantially coaxial with the passageway of the hinge plate; and a hinge pin disposed in the passageways to pivotally couple the pivot arm to the hinge plate, the hinge pin having a longitudinal axis;

the pivot arm being pivotable about the longitudinal axis of the hinge pin between a closed position in which mating surfaces of the hinge plate and the pivot arm are substantially in contact with one another, and an open position in which the mating surfaces of the hinge plate and the pivot arm are rotated away from one another, wherein in the closed position one of the mounting holes is a covered mounting hole and the other two mounting holes are not covered and are accessible;

the pivot arm including a domed portion formed therein, the domed portion defining a cavity positioned to overlie the covered mounting hole when the pivot arm is in the closed position with the other two mounting holes accessible, the cavity being sized and positioned so as to provide clearance for a head of a mounting screw or bolt secured in the covered mounting hole in the closed position.

2. The tamper resistant hinge assembly of claim 1 wherein:

the pin-receiving portion of the hinge plate comprises two separate regions defining a space therebetween; and the pin-receiving portion of the pivot arm comprises a single central region that slidingly fits into the space defined between the two separate regions of the pin-receiving portion of the hinge plate.

3. The tamper resistant hinge assembly of claim 1 wherein the covered mounting hole is a center one of the three mounting holes in the hinge plate.

4. The tamper resistant hinge assembly of claim 1 wherein the second end of the pivot arm is arcuate in shape.

5. The tamper resistant hinge assembly of claim 1 wherein the second end of the pivot arm is flat.

6. A bar lock comprising:

a bar;

first and second tamper resistant hinge assemblies, each hinge assembly comprising:

a generally planar hinge plate having first and second ends, a pin-receiving portion disposed along the first end, the pin-receiving portion defining a passageway along the first end of the hinge plate, the hinge plate including a flat portion having three mounting holes formed therethrough;

a generally planar pivot arm having first and second ends, a pin-receiving portion disposed along the first end, the pin receiving portion defining a passageway that is substantially coaxial with the passageway of the hinge plate, the second end of the pivot arm being arcuate in shape;

a hinge pin disposed in the passageways to pivotally couple the pivot arm to the hinge plate, the hinge pin having a longitudinal axis;

the pivot arm being pivotable between a closed position in which mating surfaces of the hinge plate and the pivot arm are substantially in contact with one another, and an open position in which the mating surfaces of the hinge plate and the pivot arm rotate away from one another about the longitudinal axis of the hinge pin;

the pivot arm including a domed portion formed therein, the domed portion defining a cavity positioned to overlie a center one of the three mounting holes in the hinge plate when the pivot arm is in the closed position and the other two mounting holes are not covered and are accessible, the cavity being sized and positioned so as to provide clearance for a head of a mounting screw or bolt secured in the center one of the three mounting holes as the pivot arm is rotated from the closed position to the open position; and a bar nested into and attached to the arcuate second ends of the pivot arms of the first and second hinge assemblies in a spaced apart configuration; and a handle coupled to the bar to rotate the bar to position the hinge assemblies in either of the closed position and the open position.

* * * * *